US011479732B1

(12) United States Patent
Obot et al.

(10) Patent No.: US 11,479,732 B1
(45) Date of Patent: Oct. 25, 2022

(54) SWEET CORROSION INHIBITOR COMPOSITION FOR USE IN THE OIL AND GAS INDUSTRY

(71) Applicant: KING FAHD UNIVERSITY OF PETROLEUM AND MINERALS, Dhahran (SA)

(72) Inventors: Ime Bassey Obot, Dhahran (SA); Ahmad A. Sorour, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 17/570,866

(22) Filed: Jan. 7, 2022

(51) Int. Cl.
*C10G 75/02* (2006.01)
*C23F 11/16* (2006.01)

(52) U.S. Cl.
CPC ..... *C10G 75/02* (2013.01); *C10G 2300/4075* (2013.01)

(58) Field of Classification Search
CPC ..... C10G 75/02; C23F 11/141; C23F 11/16
See application file for complete search history.

(56) References Cited

U.S. PATENT DOCUMENTS

| | | | | |
|---|---|---|---|---|
| 9,303,236 | B2 | 4/2016 | Bennet et al. | |
| 10,626,319 | B1 | 4/2020 | Obot et al. | |
| 2021/0253938 | A1* | 8/2021 | Meng | C09K 15/26 |

FOREIGN PATENT DOCUMENTS

| | | | |
|---|---|---|---|
| CN | 1206390 | C | 6/2005 |
| CN | 103668219 | A | 3/2014 |
| CN | 103710707 | B | 5/2016 |
| CN | 107142481 | A | 9/2017 |
| CN | 110157402 | A | 8/2019 |

OTHER PUBLICATIONS

Smith, et al. ; The reactions of amine, polyamine and amino alcohol corrosion inhibitors in water at high temperature ; Journal of the Chemical Society, Perkin Transactions 2, Issue 6, 1992 ; Abstract Only.

* cited by examiner

*Primary Examiner* — Randy Boyer
(74) *Attorney, Agent, or Firm* — Oblon, McClelland, Maier & Neustadt, L.L.P.

(57) ABSTRACT

A corrosion inhibiting composition and methods of inhibiting corrosion of a metal surface for use in the oil and gas industry. The corrosion inhibitor includes at least one polyamine, an alkanolamine, at least one surfactant, preferably a linear alkyl alcohol ethoxylate, at least one thioglycol compound, and at least one alcohol solvent. The methods include combining effective amounts of the corrosion inhibitor composition and contacting a metal surface in carbon dioxide-containing aqueous environments commonly found in oil and gas industry. The composition is very effective against corrosion of metals in contact with aqueous sweet corrosive brine media when used in a dosage from 50-100 ppm.

20 Claims, 3 Drawing Sheets

SWEET CORROSION INHIBITOR COMPOSITION FOR USE IN THE OIL AND GAS INDUSTRY

BACKGROUND OF THE INVENTION

Field of the Invention

The present disclosure relates to a corrosion inhibitor intended for use to prevent sweet corrosion. The corrosion inhibitor may find particular use in the oil and gas industry.

Discussion of the Background

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Corrosion is a persistent issue in the oil and gas industry. This is because corrosion issues contribute to a significant portion of the annual budget of this industry [M. Finšgar, J. Jackson, Application of corrosion inhibitors for steels in acidic media for the oil and gas industry: A review, Corros. Sci. 86 (2014) 17-41—incorporated herein by reference in its entirety]. In this regard, employing suitable corrosion control measures can aid in preventing disasters such as spillages, loss of lives and other negative social impacts [M. M. Osman, M. N. Shalaby, Some ethoxylated fatty acids as corrosion inhibitors for low carbon steel in formation water, Mater. Chem. Phys. 77 (2003) 261-269; and P. C. Okafor, X. Liu, Y. G. Zheng, Corrosion inhibition of mild steel by ethylamino imidazoline derivative in $CO_2$-saturated solution, Corros. Sci. 51 (2009) 761-768—each incorporated herein by reference in their entirety]. Corrosion takes place at all production stages in oil and gas industries, that is, from downhole to surface equipment, processing and well treatments. Corrosion in the oil and gas industry is typically divided into two broad categories: sour corrosion which involves hydrogen sulfide or other sulfide-containing compounds, and sweet corrosion which does not involve these compounds. [Perez, T. E. Corrosion in the Oil and Gas Industry: An Increasing Challenge for Materials. JOM 65 (2013) 1033-1042—incorporated herein by reference in its entirety].

A frequent source of sweet corrosion is from carbonic acid produced when carbon dioxide, a gas at standard temperature and pressure, is dissolved in aqueous solutions. Particularly common is carbon dioxide corrosion in brine solutions frequently encountered in the oil and gas industry from natural and artificial sources. For example, naturally occurring brines may encounter carbon dioxide used in carbon dioxide flooding treatments, solutions used in applications such as hydraulic fracturing may be exposed to atmospheric or geological carbon dioxide, or groundwater may naturally encounter geological carbon dioxide. Carbon dioxide flooding, also known as carbon dioxide injection is a method of enhanced oil recovery in which carbon dioxide gas is deliberately introduced into an oil-containing geological formation to increase the amount of oil which can be recovered from the formation. The main types of carbon dioxide flooding are:

(i) Continuous $CO_2$ injection: This process requires continuous injection of a predetermined volume of $CO_2$ with no other fluid. Sometimes a lighter gas, such as nitrogen, follows $CO_2$ injection to maximize gravity segregation. This approach is implemented after primary recovery and is generally suitable for gravity drainage of reservoirs with medium to light oil as well as reservoirs that are strongly water-wet or are sensitive to waterflooding.

(ii) Continuous $CO_2$ injection followed with water: This process is the same as the continuous $CO_2$ injection process except for chase water that follows the total injected $CO_2$ slug volume. This process works well in reservoirs of low permeability or moderately homogenous reservoirs.

(iii) Conventional water-alternating-gas (WAG) followed with water: In this process, a predetermined volume of $CO_2$ is injected in cycles alternating with equal volumes of water. This process is suitable for most of the reservoirs with permeability contrasts among various layers.

(iv) Tapered WAG: This design is similar in concept to the conventional WAG but with gradual reduction in the injected $CO_2$ volume relative to the water volume. With an objective to improve $CO_2$ utilization, tapered WAG is the method most widely used today because this design improves the efficiency of the flood and prevents early breakthrough of the $CO_2$, thus less recycled $CO_2$ and better oil recoveries.

(v) WAG followed with gas: This process is a conventional WAG process followed by a chase of less expensive gas (for example air or nitrogen) after the full CO2 slug volume has been injected. [Verma, M. K., 2015, Fundamentals of carbon dioxide-enhanced oil recovery ($CO_2$-EOR)—A supporting document of the assessment methodology for hydrocarbon recovery using $CO_2$-EOR associated with carbon sequestration: U.S. Geological Survey Open-File Report 2015-1071-incorporated herein by reference in its entirety]

Each of these methods create conditions in which corrosion is of major concern.

The electrochemistry of the corrosion involves the dissolution of $CO_2$ gas in the aqueous brine solution to form the weak carbonic acid ($H_2CO_3$). This is followed by several cathodic half-reactions depending on the prevalent pH of the aqueous environment [S. Nesic, J. Postlethwaite, S. Olsen, An electrochemical model for prediction of corrosion of mild steel in aqueous carbon dioxide solutions, Corrosion 52 (1996) 280-294]. The principal anodic half-reaction is the oxidation of iron (Fe) atoms into iron (II) ($Fe^{2+}$) ions. These processes are shown in the following equations:

$$CO_{2(g)}+H_2O_{(1)}\leftrightarrow H_2CO_{3(aq)} \quad (1)$$

Cathodic Reactions:

$$2H_2CO_{3(aq)}+2e^-\rightarrow H_{2(g)}+2HCO_{3(aq)}^-;\ (\text{pH } 4\text{-}6) \quad (2)$$

$$2HCO_{3(aq)}^-+2e^-\rightarrow H_{2(g)}+2CO_{3(aq)}^{2-};\ (\text{pH } 6) \quad (3)$$

$$2H^+_{(aq)}+2e^-\rightarrow H_{2(g)};\ (\text{pH}<4) \quad (4)$$

Anodic Reaction:

$$Fe_{(s)}\rightarrow Fe_{(aq)}^{2+}+2e^- \quad (5)$$

The creation of carbonic acid during various non-acidizing treatments or processes thus, can cause severe corrosion damage to carbon steel. Carbon steel is the most widely used steel due to its relatively cheap cost and abundance. This creates major problems for the oil and gas industry in which carbon steel is used for a wide variety of components related to petroleum and natural gas production. To mitigate corrosion and related damage, chemical compounds, either organic or inorganic are added to these treatment acids.

These organic molecules usually adsorb to the surface of the metal and form complexes through heterogeneous atoms such as phosphorus, sulfur, oxygen, nitrogen etc. See A. A. Farag, T. A. Ali, The enhancing of 2-pyrazinecarboxamide inhibition effect on the acid corrosion of carbon steel in presence of iodide ions, J. Ind. Eng. Chem. 21 (2015) 627-634-incorporated herein by reference in its entirety. Numerous compounds such as quinolines, imidazolines, thioureas, pyridines and their various derivatives, alkenylphenones, amines, amides, acetylenic alcohols, and quaternary salts have been employed as corrosion inhibitors of carbon steel during stimulation treatments. For examples of such chemical corrosion inhibitors, see A. H. Mustafa, B. Ari-Wahjoedi, M. C. Ismail, Inhibition of $CO_2$ corrosion of X52 steel by imidazoline-based inhibitor in high pressure $CO_2$-water environment, Materials Engineering & Performance 22 (2013) 1748-1755; U.S. Pat. No. 7,057,050 B2; V. Jovancicevic, S. Ramachandran, P. Prince, Inhibition of carbon dioxide corrosion of mild steel by imidazolines and their precursors, Corrosion 55(1999) 449-455; F. Farelas, A. Ramirez, Carbon dioxide corrosion inhibition of carbon steels through bis-imidazoline and imidazoline compounds studied by EIS, Int. J. Electrochemical Science 5 (2010) 797-814—each incorporated herein by reference in their entirety.

Other corrosion inhibitors such as sulfoxides, thioethers, mercaptans, thiazoles, thiocyanates, sulfonic acids, fatty acids, and sulfonium compounds have also been used to combat corrosion. Such corrosion inhibitors are typically included in formulations which also contain multiple other components. For example, U.S. Pat. No. 8,618,027 B2 describes a corrosion inhibitor which comprises a fatty acid; an alkanolamine, an alkylamine, and an organic sulfonic acid—incorporated herein by reference in its entirety. Additionally, US Patent Application 20150069301A1 describes a corrosion inhibitor which comprises an amide compound, an organic alkynol, a mercaptan acid, piperidine, mercaptopyridine, and a solvent-incorporated herein by reference in its entirety.

Historically, chromates and arsenate compounds are some of the inorganic compounds utilized in stimulation treatments, while acetylenic alcohols have been extensively utilized because of their relatively cheap cost and availability. However, the utilization of some of these compounds such as chromates and arsenates can be hazardous. Chromates have been shown to be carcinogenic, while arsenates are one of the main causes of arsenic poisoning. Due to these toxicity issues, a major focus has been drawn to green and environmental friendly organic corrosion inhibitor compositions.

These complex specialty corrosion inhibitors, such as the imidazoline compounds of U.S. Pat. No. 7,057,050 B2, suffer from other challenges to their widespread use. Factors such as high cost, specialty chemical availability, difficulties in scaling-up the formulations, or high concentrations to achieve effective corrosion inhibition are significant barriers to adoption of these corrosion inhibitors in the industry.

In view of the forgoing, there is a need for inexpensive, effective, and non-toxic corrosion inhibitors formulations for preventing corrosion of metal in various oil and gas field environments, including high temperature and highly corrosive conditions common to acid stimulation or carbon dioxide flooding operations.

SUMMARY OF THE INVENTION

The present disclosure relates to a corrosion inhibitor, comprising: 15 to 30 wt % of an alkanolamine having 2 to 8 carbon atoms, 10.5 to 30 wt % of a polyamine having 2 to 12 carbon atoms, 15 to 30 wt % of a thioglycol having 2 to 8 carbon atoms, 1 to 9 wt % of a non-ionic surfactant, and 1 to 58.5 wt % of an alcohol solvent, each based on a total weight of corrosion inhibitor. The corrosion inhibitor is substantially free of sulfonic acids.

In some embodiments, the alkanolamine is ethanolamine.

In some embodiments, the polyamine is hexamethylenetetramine.

In some embodiments, the thioglycol is 2-mercaptoethanol.

In some embodiments, the non-ionic surfactant is an alcohol ethoxylate of formula (1)

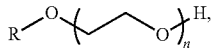

(1)

wherein R is a linear hydrocarbon chain having 8 to 22 carbon atoms and n is an integer 2 to 12.

In some embodiments, the alcohol ethoxylate of formula (1) has n=7.

In some embodiments, the alcohol ethoxylate of formula (1) has R being a saturated linear hydrocarbon chain having 8 to 22 carbon atoms.

In some embodiments, the alcohol ethoxylate of formula (1) has R being a linear hydrocarbon chain having 14 to 20 carbon atoms.

In some embodiments, the alcohol solvent is methanol.

The present disclosure also relates to a method of inhibiting corrosion of a metal in contact with a corrosive fluid, the method comprising adding to the corrosive fluid the corrosion inhibitor in an amount of 10 to 1000 ppm based on a total number of parts of the corrosive fluid.

In some embodiments, the corrosive fluid is an aqueous solution.

In some embodiments, the corrosive fluid comprises carbon dioxide and/or carbonic acid present in an amount of at least 0.5 g carbon dioxide and/or carbonic acid per kg of corrosive fluid.

In some embodiments, the corrosive fluid comprises a dissolved halide salt.

In some embodiments, the dissolved halide salt is present in an amount of 1 to 5 wt % based on a total weight of corrosive fluid.

In some embodiments, the corrosive fluid is substantially free of hydrogen sulfide.

In some embodiments, the metal is a steel.

In some embodiments, the steel is a carbon steel.

In some embodiments, the metal is in contact with the corrosive fluid at 25 to 100° C.

In some embodiments, the metal is part of a casing, a pipe, a pump, a screen, a valve, or a fitting of an oil or gas well.

In some embodiments, the method has an inhibition efficiency of greater than 90% when the metal is in contact with the solution at 30 to 70° C. for 30 to 90 minutes.

BRIEF DESCRIPTION OF THE DRAWINGS

The forgoing paragraphs have been provided by way of general introduction, and are not intended to limit the scope of the following claims. A more complete appreciation of the invention and many of the attendant advantages thereof will be readily obtained as the same becomes better understood by reference to the following detailed description when considered in connection with the accompanying drawings, wherein:

FIG. 3A is Nyquist plot of the electrochemical impedance measured for C1018 carbon steel coupon in 3.5% NaCl in saturated $CO_2$ at 55° C. without and after the addition of 50 and 100 ppm of the corrosion inhibitor formulation CoRE-C-1, and FIG. 3B shows a theoretical circuit used to model the experimental results;

DETAILED DESCRIPTION OF THE INVENTION

Figure 1:
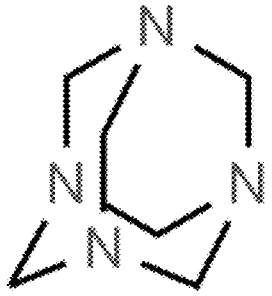
FIG. 1 shows the chemical structure of hexamethylenetetramine.

In the following description, it is understood that other embodiments may be utilized and structural and operational changes may be made without departure from the scope of the present embodiments disclosed herein.

Definitions

As used herein the words "a" and "an" and the like carry the meaning of "one or more."

As used herein the term "corrosion inhibitor" refers to a substance(s) that prevents or reduces the deterioration of a metal surface by oxidation or other chemical reaction. Corrosive substances that can cause corrosion, particularly of metal surfaces of equipment used during stimulation operations, include water with high salt contents, acidic inorganic compounds such as hydrochloric acid, hydrofluoric acid, carbon dioxide ($CO_2$) and/or hydrogen sulfide ($H_2S$), organic acids, and microorganisms. Preferred corrosion inhibitors of the present invention reduce, inhibit and/or prevent the destructive effect such substances have on various metal surfaces.

As used herein, the term "fatty" describes a compound with a long-chain (linear) hydrophobic portion made up of hydrogen and anywhere from 6 to 26, 8 to 24, 10 to 22, 12 to 20, 14 to 18 carbon atoms, which may be fully saturated or partially unsaturated, and optionally attached to a polar functional group such as a hydroxyl group, an amine group, or a carboxyl group (e.g., carboxylic acid). Fatty alcohols, fatty amines, fatty acids, fatty esters, and fatty amides are examples of materials which contain a fatty portion, and are thus considered "fatty" compounds herein. For example, stearic acid, which has 18 carbons total (a fatty portion with 17 carbon atoms and 1 carbon atom from the —COOH group), is considered to be a fatty acid having 18 carbon atoms herein.

As used herein, "alkoxylated" or "alkoxylate" refers to compounds containing a (poly)ether group (i.e., (poly)oxyalkylene group) derived from reaction with, oligomerization of, or polymerization of one or more alkylene oxides having 2 to 4 carbon atoms, and specifically includes (poly)oxyethylene (derived from ethylene oxide, EO), (poly)oxypropylene (derived from propylene oxide, PO), and (poly)oxybutylene (derived from butylene oxide, BO), as well as mixtures thereof.

The term "alkyl", as used herein, unless otherwise specified, refers to a straight, branched, or cyclic, aliphatic fragment having 1 to 26 carbon atoms, preferably 2 to 24, preferably 3 to 22, preferably 4 to 20, preferably 5 to 18, preferably 6 to 16, preferably 7 to 14, preferably 8 to 12, preferably 9 to 10. Non-limiting examples include, but are not limited to, methyl, ethyl, propyl, isopropyl, butyl, isobutyl, t-butyl, pentyl, isopentyl, neopentyl, hexyl, isohexyl, 3-methylpentyl, 2,2-dimethylbutyl, 2,3-dimethylbutyl, lauryl, myristyl, cetyl, stearyl, and the like, including guerbet-type alkyl groups (e.g., 2-methylpentyl, 2-ethylhexyl, 2-proylheptyl, 2-butyloctyl, 2-pentylnonyl, 2-hexyldecyl, 2-heptylundecyl, 2-octyldodecyl, 2-nonyltridecyl, 2-decyltetradecyl, and 2-undecylpentadecyl), and unsaturated alkenyl and alkynyl variants such as vinyl, allyl, 1-propenyl, 2-propenyl, 1-butenyl, 2-butenyl, 3-butenyl, 1-pentenyl, 2-pentenyl, 3-pentenyl, 4-pentenyl, 1-hexenyl, 2-hexenyl, 3-hexenyl, 4-hexenyl, 5-hexenyl, oleyl, linoleyl, and the like. Cycloalkyl is a type of cyclized alkyl group. Exemplary cycloalkyl groups include, but are not limited to, cyclopropyl, cyclobutyl, cyclopentyl, cyclohexyl, norbornyl, and adamantyl. The term "lower alkyl" is used herein to describe alkyl groups having 1 to 5 carbon atoms (e.g., methyl, ethyl, n-propyl, etc.).

As used herein, unless otherwise specified, the term "aryl" refers to an aromatic group containing only carbon in the aromatic ring(s), such as phenyl, biphenyl, naphthyl, anthracenyl, and the like. The term "heteroarene" refers to an arene compound or aryl group where at least one carbon atom is replaced with a heteroatom (e.g., nitrogen, oxygen, sulfur) and includes, but is not limited to, pyridine, pyrimidine, quinoline, isoquinoline, pyrazine, pyridazine, indole, pyrrole, oxazole, thiozole, furan, benzofuran, thiophene, benzothiophene, isoxazole, pyrazole, triazole, tetrazole, indazole, purine, carbazole, imidazole, benzothiozole, and benzimidazole.

As used herein, "alkanoyloxy" groups are alkanoyl groups that are bound to oxygen (—O—C(O)-alkyl), for example, acetyloxy, propionyloxy, butyryloxy, isobutyryloxy, pivaloyloxy, valeryloxy, hexanoyloxy, octanoyloxy, lauroyloxy, and stearoyloxy. "Alkoxycarbonyl" substituents are alkoxy groups bound to C═O (e.g. —C(O)—Oalkyl), for example methyl ester, ethyl ester, and pivaloyl ester substitution where the carbonyl functionality is bound to the rest of the compound.

As used herein, "optionally substituted" means that at least one hydrogen atom is replaced with a non-hydrogen group, provided that normal valencies are maintained and that the substitution results in a stable compound. Such optional substituents may be selected from aryl, alkoxy, aryloxy, arylalkyloxy, alkanoyloxy, carboxy, alkoxycarbonyl, hydroxy, halo (e.g. chlorine, bromine, fluorine or iodine), amino (e.g. alkylamino, arylamino, arylalkylamino, alkanoylamino, either mono- or disubstituted), oxo, amido (e.g. —$CONH_2$, —CONHalkyl, —CONHaryl, —CONHarylalkyl or cases where there are two substituents on one nitrogen), and the like.

As used herein, the phrase "acid stimulation" or "acidizing" refers to the general process of introducing an acidic fluid downhole to perform at least one of the following functions: (1) to react with and to dissolve the area surrounding the well which has been damaged; (2) to react with and to dissolve rock associated with the geological formation to create small conducting channels (e.g., conducting wormholes) through which the hydrocarbon will flow; and (3) to create a large flow channel by injecting acidic fluids through the well at pressures sufficient to fracture the rock, thus allowing the hydrocarbon to migrate rapidly from the rock to the well. Thus, "acid stimulation" or "acidizing" may refer to either or both matrix acidizing and fracture acidizing treatments.

The phrase "substantially free", unless otherwise specified, describes a particular component being present in an amount of less than about 1 wt. %, preferably less than about 0.5 wt. %, more preferably less than about 0.1 wt. %, even more preferably less than about 0.05 wt. %, yet even more preferably 0 wt. %, relative to a total weight of the composition being discussed.

As used herein, the terms "optional" or "optionally" means that the subsequently described event(s) can or cannot occur or the subsequently described component(s) may or may not be present (e.g., 0 wt. %).

Corrosion Inhibitor

Petroleum oil and natural gas wells are typically subjected to numerous chemical treatments during their production life to enhance operation and protect the integrity of the well and all related equipment. For example, acidic fluids (HCl, HF, etc.) are often used in stimulation operations such as in matrix acidizing and fracture acidizing treatments, where acidic fluids are injected into the well penetrating the rock pores to stimulate the well to improve flow or to remove damage. In matrix acidizing treatments, acidic treatment fluids are either injected into the well to react with and to dissolve the area surrounding the well to remove damage around the wellbore, or introduced into the subterranean formation under pressure (but below the fracture pressure) so that the acidic treatment fluids flow into the pore spaces of the formation and react with acid-soluble materials contained in the formation, resulting in an increase in the size of the pore spaces and an increase in the permeability of the formation. In fracture-acidizing treatments, the acidic treatment fluids are introduced above the fracture point of the formation to etch flow channels in the fracture face of the formation and to enlarge the pore spaces in the formation. The increase in formation permeability from these types of acidic treatments may increase the recovery of hydrocarbons from the formation. In most cases, acid stimulation procedures are carried out in calcareous formations such as dolomites, limestones, dolomitic sandstones, and the like.

Acidic fluids may also be created during other processes. One example of such a process is carbon dioxide flooding. Carbon dioxide flooding is a process which involves the injection of carbon dioxide into petroleum or natural gas reservoir to enhance the output of the reservoir. The introduction of the carbon dioxide can increase the pressure inside the reservoir and/or decrease the viscosity of petroleum within the reservoir. Carbon dioxide flooding is typically performed with the injection of an oil-immiscible fluid to, for example, further increase the pressure within the reservoir. The most frequently used oil-immiscible fluid is water. This water may have a wide variety of additives, such as polymers or dissolved salts, and/or may dissolve certain components from the geological formation in which the reservoir is located. Additionally, water may already be present in the geological formation or seep into the reservoir during other activities related to petroleum extraction. Similar to the water which may be added during carbon dioxide flooding, the water already present in or which has seeped into the reservoir or formation may also dissolve certain components or contain certain dissolved components from the geological formation, particularly salts. In this context, the water containing dissolved salts (either from additives or geological components) is frequently referred to as a brine. When this brine comes into contact with the carbon dioxide used in the flooding process, an acidic fluid comprising the brine and carbon dioxide, at least some of which dissolves into the brine to create carbonic acid, is made.

A common problem associated with using acidic treatment fluids in subterranean formations is the corrosion of metal surfaces in piping, tubing, heat exchangers, reactors, downhole tools, and the other equipment which are exposed to such acid treatments. Further, other corrosive components such as brines, carbon dioxide, hydrogen sulfide, and microorganisms, may be entrained within the acidic stimulation fluids during stimulation, exacerbating the corrosion problem. Moreover, elevated temperatures are commonly encountered in deeper formations, which increases the rate of corrosion. Corrosion issues are problematic for any drilling operation, but are even more troublesome in deep-sea operations where replacement of corroded equipment is difficult and costly.

Therefore, it is common practice to employ corrosion inhibitors during acid stimulation treatments, normal petroleum recovery, and/or enhanced oil recovery methods like carbon dioxide flooding of crude oil and natural gas wells. However, many corrosion inhibitors suffer from poor performance at low concentrations and particularly poor performance under high temperatures and under strongly acidic solutions, for example acidic solutions containing greater than or equal to 15 wt. % acid, necessitating the need for large quantities of corrosion inhibitors to be used. The use of large quantities of corrosion inhibitors is extremely undesirable when corrosion inhibitors are deployed in terms of both cost and from environmental concerns.

According to a first aspect, the present disclosure relates to a corrosion inhibitor. The corrosion inhibitor comprises 15 to 30 wt % of an alkanolamine having 2 to 8 carbon atoms, 10.5 to 30 wt % of a polyamine having 2 to 12 carbon atoms, 15 to 30 wt % of a thioglycol having 2 to 8 carbon atoms, 1 to 9 wt % of a non-ionic surfactant, and 1 to 58.5 wt % of an alcohol solvent, each based on a total weight of corrosion inhibitor, and the corrosion inhibitor is substantially free of sulfonic acids.

In general, the alkanolamine (also known as an amino alcohol) may be any suitable alkanolamine known to one of ordinary skill in the art having 2 to 8 carbon atoms. In preferred embodiments, the alkanolamine has 2 to 6 carbon atoms. In some embodiments, the alkanolamine contains a primary amine functional group. In alternative embodiments, the alkanolamine contains a secondary amine functional group. In other alternative embodiments, the alkanolamine contains a tertiary amine functional group. In some embodiments, the alkanolamine contains a primary alcohol functional group. In alternative embodiments, the alkanolamine contains a secondary alcohol functional group. In other alternative embodiments, the alkanolamine contains a tertiary alcohol functional group. In some embodiments, the alkanolamine is an alkyl alkanolamine. In alternative embodiments, the alkanolamine is an aryl alkanolamine. Examples of suitable alkanolamines are, ethanolamine, N-methyl ethanolamine, diethanolamine, N-methyl diethanolamine, N,N-dimethyl ethanolamine, N,N-diethyl ethanolamine, triethanolamine, 2-amino-1-propanol, 3-amino-1-propanol, 3-amino-2-propanol, diglycolamine, 2-amino-2-methyl-1-propanol (also known as aminomethyl propanol), 2-piperidineethanol, prolinol, and valinol. In preferred embodiments, the alkanolamine is ethanolamine.

The alkanolamine may be present in the corrosion inhibitor in an amount of 15 to 30 wt %, preferably 17 to 29.5 wt %, preferably 19 to 29 wt %, preferably 21 to 28.5 wt %, preferably 23 to 28 wt %, preferably 25 to 27.5 wt %, preferably 26 to 27 wt %, preferably 26.25 to 26.75 wt %, preferably about 26.6 wt % based on a total weight of corrosion inhibitor.

The corrosion inhibitor also comprises a polyamine. In general, the polyamine may be any suitable polyamine known to one of ordinary skill in the art having 2 to 12 carbon atoms. In some embodiments, the polyamine has 2 to 12 carbon atoms, preferably 3 to 10 carbon atoms, preferably 4 to 8 carbon atoms, preferably 5 to 7 carbon atoms, preferably 6 carbon atoms. In some embodiments, the polyamine contains only primary amine functionalities. In some embodiments, the polyamine contains only secondary amine functionalities. In some embodiments, the polyamine contains only tertiary amine functionalities. In some embodiments, the polyamine contains only primary and secondary amine functionalities. In some embodiments, the polyamine contains only primary and tertiary amine functionalities.

In some embodiments, the polyamine contains only secondary and tertiary amine functionalities. In some embodiments, the polyamine contains primary, secondary, and tertiary amine functionalities. In general, the polyamine must have at least two amine functionalities. In some embodiments, the polyamine has 2 to 10 amine functionalities, preferably 3 to 8, preferably 4 to 6 amine functionalities. The polyamine may be an alkyl polyamine, an aryl polyamine, or a polyamine containing both aryl and alkyl groups. While the polyamine may have other, non-amine functional groups, such as ether, ester, carbonyl, and amide functional groups, the polyamine is preferably devoid of alcohol, thiol, carboxylic acid, and phenol functional groups. Examples of such suitable polyamines are ethylenediamine, 1,2-diaminopropane, 1,2-diaminocyclohexane, 2,3-diaminobutane, propane-1,2,3-triamine, tris(2-aminoethyl) amine, tetraethylenepentamine (TEPA), diethylenetriamine (DETA), triethylentetramine (TETA), aminoethylethanolamine (AEEA), pentaethylene hexamine (PEHA), hexaethylene heptamine (HEHA), diethylenetriamine, triethylenetriamine, methylphenylenediamine, diaminodiphenylmethane, and hexamethylenetetramine. In some embodiments, the polyamine is hexamethylenetetramine (also known as methenamine, hexamine, and/or urotropin).

The polyamine may be present in the corrosion inhibitor in an amount of 10.5 to 30 wt %, preferably 11 to 29 wt %, preferably 11.5 to 28.5 wt %, preferably 12 to 28 wt %, preferably 12.5 to 27.5 wt %, preferably 13 to 27 wt %, preferably 13.5 to 26.5 wt %, preferably 14 to 26 wt %, preferably 14.5 to 25.5 wt %, preferably 15 to 25 wt %, preferably 15.5 to 24.5 wt %, preferably 16 to 24 wt %, preferably 16.5 to 23.5 wt %, preferably 17 to 23 wt %, preferably 17.5 to 22.5 wt %, preferably 18 to 22 wt %, preferably 18.5 to 21.5 wt %, preferably 19 to 21 wt %, preferably 19.5 to 20.5 wt %, preferably 19.9 to 20.1 wt %, preferably about 20 wt %, based on a total weight of corrosion inhibitor.

The corrosion inhibitor also comprises a thioglycol. In general, the thioglycol may be any suitable thioglycol known to one of ordinary skill in the art having 2 to 8 carbon atoms. In some embodiments, the thioglycol is a thiodiglycol. In some embodiments, the thioglycol is an S-alkyl or S-aryl thioglycol. In some embodiments, the thioglycol is a thioglycol alkoxylate or a thiodiglycol alkoxylate. In preferred embodiments, the thioglycol has a free alcohol functionality (e.g., one that is not alkylated). In preferred embodiments, the thioglycol has a free thiol functionality (e.g., one that is not alkylated). In general, the thioglycol may contain ether, thioether (also referred to as sulfide), halide, or other functional groups, but should preferably be free of carboxylic acid, acid anhydride, ester, acyl halide, amide, nitrile, aldehyde, thioaldehyde, sulfonic acid, and amine functional groups. Examples of suitable thioglycols are 2-mercaptoethanol, 2-(methylthio)ethanol, 2-(ethylthio) ethanol, thioglycol ethoxylate, thioglycol propoxylate, thioglycol butoxylate, thiodiglycol ethoxylate, thiodiglycol propoxylate, thiodiglycol butoxylate. In preferred embodiments, the thioglycol is 2-mercaptoethanol.

The thioglycol may be present in the corrosion inhibitor in an amount of 15 to 30 wt %, preferably 17 to 29.5 wt %, preferably 19 to 29 wt %, preferably 21 to 28.5 wt %, preferably 23 to 28 wt %, preferably 25 to 27.5 wt %, preferably 26 to 27 wt %, preferably 26.25 to 26.75 wt %, preferably about 26.6 wt % based on a total weight of corrosion inhibitor.

The corrosion inhibitor also comprises a non-ionic surfactant. In general, the non-ionic surfactant may be any suitable non-ionic surfactant known to one of ordinary skill in the art. Non-ionic surfactants may include, but are not limited to:

(i) alkanolamides of fatty acids, that is, amide reaction products between a fatty acid and an alkanolamine compound, such as coconut fatty acid monoethanolamide (e.g., N-methyl coco fatty ethanol amide), coconut fatty acid diethanolamide, oleic acid diethanolamide, and vegetable oil fatty acid diethanolamide;

(ii) alkoxylated alkanolamides of fatty acids, preferably ethoxylated and/or propoxylated variants of the alkanolamides of fatty acids using for example 5 anywhere from 2 to 30 EO and/or PO molar equivalents, preferably 3 to 15 EO and/or PO molar equivalents, preferably 4 to 10 EO and/or PO molar equivalents, preferably 5 to 8 EO and/or PO molar equivalents per moles of the alkanolamide of the fatty acid (e.g., coconut fatty acid monoethanolamide with 4 moles of ethylene oxide);

(iii) amine oxides, such as N-cocoamidopropyl dimethyl amine oxide and dimethyl C6-C22 alkyl amine oxide (e.g., dimethyl coco amine oxide);

(iv) fatty esters, such as ethoxylated and/or propoxylated fatty acids (e.g., castor oil with 2 to 40 moles of ethylene oxide), alkoxylated glycerides (e.g., PEG-24 glyceryl monostearate), glycol esters and derivatives, monoglycerides, polyglyceryl esters, esters of polyalcohols, and sorbitan/sorbitol esters;

(v) ethers, such as (a) alkoxylated C1-C22 alkanols, which may include alkoxylated C1-C5 alkanols, preferably ethoxylated or propoxylated C1-C5 alkanols (e.g., dipropylene glycol n-butyl ether, tripropylene glycol n-butyl ether, dipropylene glycol methyl ether, tripropylene glycol methyl ether, diethylene glycol n-butyl ether, triethylene glycol n-butyl ether, diethylene glycol methyl ether, triethylene glycol methyl ether) and alkoxylated C6-C26 alkanols (including alkoxylated fatty alcohols), preferably alkoxylated C7-C22 alkanols, more preferably alkoxylated C8-C14 alkanols, preferably ethoxylated or propoxylated (e.g., cetyl stearyl alcohol with 2 to 40 moles of ethylene oxide, lauric alcohol with 2 to 40 moles of ethylene oxide, oleic alcohol with 2 to 40 moles of ethylene oxide, ethoxylated lanoline derivatives, laureth-3, ceteareth-6, ceteareth-11, ceteareth-15, ceteareth-16, ceteareth-17, ceteareth-18, ceteareth-20, ceteareth-23, ceteareth-25, ceteareth-27, ceteareth-28, ceteareth-30, isoceteth-20, laureth-9/myreth-9, and PPG-3 caprylyl ether); (b) alkoxylated polysiloxanes; (c) ethylene oxide/propylene oxide copolymers (e.g., PPG-1-PEG-9-lauryl glycol ether, PPG-12-buteth-16, PPG-3-buteth-5, PPG-5-buteth-7, PPG-7-buteth-10, PPG-9-buteth-12, PPG-12-buteth-16, PPG-15-buteth-20, PPG-20-buteth-30, PPG-28-buteth-35, and PPG-33-buteth-45); and (iv) alkoxylated alkylphenols; and (vi) mixtures thereof.

In preferred embodiments, the non-ionic surfactant is an alcohol ethoxylate of formula 1:

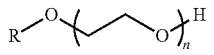

(1)

In formula 1, R is a linear hydrocarbon chain having 8 to 24 carbon atoms, preferably 10 to 23 carbon atoms, preferably 12 to 22 carbon atoms, preferably 14 to 20 carbon atoms. In some embodiments, R is a branched hydrocarbon chain. In preferred embodiments, R is a linear hydrocarbon chain. In some embodiments, R is an unsaturated hydrocarbon chain. In preferred embodiments, R is a saturated hydrocarbon chain. In formula 1, n is an integer 2 to 12, preferably 3 to 11, preferably 4 to 10, preferably 5 to 9, preferably 6 to 8, preferably 7.

The non-ionic surfactant may be present in the corrosion inhibitor in an amount of 1 to 9 wt %, preferably 1.5 to 8.75 wt %, preferably 2 to 8.5 wt %, preferably 2.5 to 8.25 wt %, preferably 3 to 8 wt %, preferably 3.5 to 7.75 wt %, preferably 4 to 7.5 wt %, preferably 4.5 to 7.25 wt %, preferably 5 to 7 wt %, preferably 5.5 to 6.75 wt %, preferably 6 to 6.6 wt %.

The corrosion inhibitor also comprises an alcohol solvent. The alcohol solvent may be at least one selected from the group consisting of a mono alcohol with 1 to 12 carbon atoms, and a polyol with 2 to 18 carbon atoms. In preferred embodiments, the alcohol solvent is an aliphatic alcohol solvent. Acceptable alcohol solvents include, but are not limited to, methanol, ethanol, propanol, isopropanol, n-butanol, isobutanol, n-pentanol, n-hexanol, terpineol, menthol, prenol, 3-methyl-3-buten-1-ol, 2-ethyl-1-hexanol, 2-ethyl-1-butanol, 2-propylheptan-1-ol, 2-butyl-1-octanol, ethylene glycol, diethylene glycol, triethylene glycol, tetraethylene glycol, ethylene glycol monomethyl ether, ethylene glycol monoethyl ether, ethylene glycol monopropyl ether, ethylene glycol monobutyl ether, diethylene glycol monomethyl ether, diethylene glycol monoethyl ether, propylene glycol, dipropylene glycol, propylene glycol monomethyl ether, pyrocatechol (1,2-benzenediol), resorcinol (1,3-benzenediol), phenol, cresol, benzyl alcohol, 1,3-propanediol, 1,3-butanediol, 2-butoxyethanol, 1,4-butanediol, 1,6-hexanediol, glycerol, pentaerythritol, manitol, sorbitol, as well as mixtures thereof. In preferred embodiments, the alcohol solvent is at least one selected from the group consisting of methanol, ethanol, propanol, isopropanol, n-butanol, isobutanol, ethylene glycol, and diethylene glycol. In preferred embodiments, the alcohol solvent is methanol.

The alcohol solvent may be present in the corrosion inhibitor in an amount of 1 to 58.5 wt %, preferably 2.5 to 55 wt %, preferably 5 to 50 wt %, preferably 7.5 to 45 wt %, preferably 10 to 40 wt %, preferably 12.5 to 35 wt %, preferably 15 to 30 wt %, preferably 17.5 to 25 wt %, preferably 19 to 22.5 wt %, preferably 20 wt %.

The composition of the corrosion inhibitor may also be understood in terms of relative ratios of certain components of which the corrosion inhibitor is comprised. In some embodiments, the corrosion inhibitor has a ratio of an amount of thioglycol present to an amount of alkanolamine present of 2:1 to 1:2, preferably 1.9:1 to 1:1.9, preferably 1.8:1 to 1:1.8, preferably 1.75:1 to 1:1.75, preferably 1.6:1 to 1:1.6, preferably 1.5:1 to 1:1.5, preferably 1.4:1 to 1:1.4, preferably 1.3:1 to 1:1.3, preferably 1.25:1 to 1:1.25, preferably 1.2:1 to 1:1.2, preferably 1.1:1 to 1:1.1, preferably 1:1. In some embodiments, the corrosion inhibitor has a ratio of an amount of alkanolamine present to an amount of polyamine present of 2.85:1 to 1:2, preferably 2.75:1 to 1:1.9, preferably 2.5:1 to 1:1.75, preferably 2.25:1 to 1:1.6, preferably 2:1 to 1.5:1, preferably 1.9:1 to 1:1.3, preferably 1.8:1 to 1:1.25, preferably 1.75:1 to 1:1.1 preferably 1.6:1 to 1:1, preferably 1.5:1 to 1.1:1, preferably 1.4:1 to 1.2:1, preferably 1.33:1. In some embodiments, the corrosion inhibitor has a ratio of an amount of thioglycol present to an amount of polyamine present of 2.85:1 to 1:2, preferably 2.75:1 to 1:1.9, preferably 2.5:1 to 1:1.75, preferably 2.25:1 to 1:1.6, preferably 2:1 to 1.5:1, preferably 1.9:1 to 1:1.3, preferably 1.8:1 to 1:1.25, preferably 1.75:1 to 1:1.1 preferably 1.6:1 to 1:1, preferably 1.5:1 to 1.1:1, preferably 1.4:1 to 1.2:1, preferably 1.33:1. In some embodiments, the corrosion inhibitor has a ratio of an amount of polyamine present to an amount of alcohol solvent present of 30:1 to 1:5.57, preferably 25:1 to 1:5, preferably 20:1 to 1:4.5, preferably 15:1 to 1:4, preferably 12.5:1 to 1:3.5, preferably 10:1 to 1:3, preferably 7.5:1 to 1:2.5, preferably 5:1 to 1:2, preferably 2.5:1 to 1:1.75, preferably 2:1 to 1:1.5, preferably 1.5:1 to 1:1.25, preferably 1:1.

In preferred embodiments, the corrosion inhibitor is substantially free of sulfonic acids. In this context, "substantially free of sulfonic acids" refers to the compositions having 1 wt % or less of compounds containing sulfonic acid functional groups (i.e., in terms of p-toluene sulfonic acid, the weight is with reference to the entire compound of p-toluene sulfonic acid), the weight percentage based on a total weight of corrosion inhibitor. In such preferred embodiments, sulfonic acids are present in the corrosion inhibitor in an amount less than 1 wt %, preferably less than 0.75 wt %, preferably less than 0.5 wt %, preferably less than 0.25 wt %, preferably less than 0.1 wt %, preferably less than 0.05 wt %, preferably less than 0.01 wt %, preferably less than 0.001 wt %, based on a total weight of corrosion inhibitor. In some embodiments, the corrosion inhibitor is substantially free of sulfonic acid functional groups. In this context, "substantially free of sulfonic acid functional groups" refers to total weight percentage of sulfonic acid groups themselves, based on the molecular weight of $HSO_3$ in the compounds containing the sulfonic acid groups present in the corrosion inhibitor (i.e., in terms of p-toluene sulfonic acid, the weight is with reference to only the contribution of HSO3 in p-toluene sulfonic acid), the weight percentage based on a total weight of the corrosion inhibitor. When defined as such, the corrosion inhibitor may be considered "substantially free of sulfonic acid functional groups" if sulfonic acid functional groups are present in the corrosion inhibitor in an amount less than 0.25 wt %, preferably less than 0.20 wt %, preferably less than 0.15 wt %, preferably less than 0.1 wt %, preferably less than 0.05 wt %, preferably less than 0.01 wt %, preferably less than 0.005 wt %, preferably less than 0.001 wt %, preferably less than 0.0005 wt %, preferably less than 0.0001 wt %, preferably less than 0.00001 wt % based on a total weight of corrosion inhibitor. In some embodiments, the corrosion inhibitor is devoid of sulfonic acids. Examples of sulfonic acids include the anionic surfactants alkylbenzene sulfonates and protonated versions thereof such as sodium dodecylbenzenesulfonate; the anionic surfactants alkyl sulfonates and protonated versions thereof such as sodium laurylsulfonate; short-chain alkyl sulfonic acids such as methanesulfonic acid, ethanesulfonic acid, propanesulfonic acid; aryl sulfonic acids such as benzenesulfonic acid and p-toluenesulfonic acid; sulfonic acid-containing dispersants such as dinonylnaphthalene sulfonic acid; sulfonic acid containing polymers such as poly(4-styrenesulfonic acid) (PSS), poly(anetholesulfonic acid) (PAS), poly(vinylsulfonic acid) (PVS), Nafion® and poly(2-acrylamido-2-methyl-1-propanesulfonic acid) (PAMPS); and fluorinated sulfonic acids such as perfluorooctanesulfonic acid and perfluorohexanesulfonic acid. The class of anionic surfactants known as "alkyl sulfonates" typically refers to sulfonic acids having an alkyl group having of 8 to 18 carbon atoms, whether in a linear or branched configuration. In this context, "short-chain alkyl sulfonic acids" is used to refer to sulfonic acids having an alkyl group having fewer than 8 carbon atoms. The anionic surfactants alkylbenzene sulfonates and alkyl sulfonates, as well as protonated versions thereof, are typically provided as mixtures of many different molecules that have one or more alkyl groups having 8 to 18 carbon atoms. Such mixtures may be classified based on the amount of branching present in the alkyl groups. One such class is linear alkyl sulfonates or linear alkylbenzene sulfonates (LAS) in which the alkyl groups having 8 to 18 carbon atoms are linear chains. Another such class is branched alkyl sulfonates or branched alkylbenzene sulfonates (BAS or BABS) which contain branched alkyl chains. For examples of such sulfonic acids which may be excluded, see U.S. Pat. No. 9,303,236 B2.

In some embodiments the corrosion inhibitor further comprises a corrosion inhibitor intensifier. A corrosion inhibitor intensifier is a compound or mixture of compounds that is capable of enhancing the performance of one or more corrosion inhibitors. Corrosion inhibitor intensifiers are typically added to or included in the formulation of corrosion inhibiting mixtures. These intensifiers may or may not act as corrosion inhibitors by themselves.

One class of corrosion inhibitor intensifiers is phosphonic acid corrosion inhibitor intensifiers. The phosphonic acid corrosion inhibitor intensifier may be a phosphonic acid, a phosphonate, an ester thereof, a salt thereof, or any combination thereof. Examples of phosphonic acid corrosion inhibitor intensifiers may include, but are not limited to, amino trimethylene phosphonic acid, bis(hexamethylenetriamine penta(methylene phosphonic acid), diethylenetriamine penta(methylene phosphonic acid), ethylenediamine tetra(methylene phosphonic acid), hexamethylenediamine tetra(methylene phosphoric acid), 1-hydroxy ethylidene-1,1-diphosphonic acid, 2-hydroxyphosphonocarboxylic acid, 2-phosphonobutane-1,2,4-tricarboxylic acid, methylene diphosphonic acid, derivatives thereof, salts thereof (e.g., sodium, potassium, ammonium, or organic radical salts), and any combination thereof.

Another class of corrosion inhibitor intensifiers is iodide corrosion inhibitor intensifiers. In general, any suitable source of iodide anions may act as an iodide corrosion inhibitor intensifier. Typically, soluble salts of iodide are used. Examples of iodide corrosion inhibitor intensifiers are potassium iodide, sodium iodide, lithium iodide, copper (I) iodide, copper (II) iodide, ammonium iodide, and organoammonium iodides such as tetramethylammonium iodide, benzyltrimethylammonium iodide, and methylammonium iodide.

Another class of corrosion inhibitor intensifiers is formate corrosion inhibitor intensifiers. The formate corrosion inhibitor intensifier may be formic acid, a salt thereof, a coordination complex thereof, an ester thereof, or a mixture of these.

In general, the corrosion inhibitor may be used in conjunction with other suitable corrosion inhibitors known to one of ordinary skill in the art. In some embodiments, the corrosion inhibitor may further comprise a secondary corrosion inhibitor. The secondary corrosion inhibitor may refer to any chemical compound or mixture thereof known by one of ordinary skill in the art to act as a corrosion inhibitor, particularly for inhibiting corrosion of steel and/or in $CO_2$-containing solutions. Such secondary corrosion inhibitors may be quinolines, imidazolines, thioureas, pyridines and their various derivatives, alkenylphenones, amines, amides, acetylenic alcohols, quaternary salts, sulfoxides, thioethers, mercaptans, thiazoles, and thiocyanates.

In some embodiments, the corrosion inhibitor may further comprise a co-solvent. As used herein, a co-solvent refers to a chemical compound added to the corrosion inhibitor primarily for the purposes of enhancing the water solubility or oil solubility of the corrosion inhibitor. Preferably, the co-solvent does not participate in chemical reactions which prevent corrosion. Examples of co-solvents include water, glycerins, glycols (e.g., polyglycols, propylene glycol, and ethylene glycol), polyglycol amines, polyols, any derivative thereof, and any combination thereof.

In general, the corrosion inhibitor described herein may be prepared using any suitable technique or combination of techniques known to one of ordinary skill in the art. In some embodiments, the components of the corrosion inhibitor are added to a single container. In such embodiments, the components may be added in sequence. In alternative embodiments, the components may be added simultaneously. In some embodiments, the alcohol solvent is provided first, and other components are added to the alcohol solvent. In some embodiments, the corrosion inhibitor is prepared before being added to the corrosive fluid. In alternative embodiments, the corrosion inhibitor is prepared by addition of the components of the corrosion inhibitor to the corrosive fluid, e.g., downhole. Such addition may be successive or simultaneous.

Method of Inhibiting Corrosion

The present disclosure also relates to a method of inhibiting corrosion of a metal in contact with a corrosive fluid. The method involves adding to the corrosive fluid the corrosion inhibitor, in one or more of its embodiments, described above.

The corrosive fluid comprises at least one corrosive substance as described above, examples of which include water with a high salt content, acidic inorganic compounds such as hydrochloric acid, hydrofluoric acid, carbon dioxide ($CO_2$) and/or hydrogen sulfide ($H_2S$), organic acids, microorganisms, and combinations thereof. In some embodiments, the corrosive fluid comprises water. In some embodiments, the corrosion inhibitor is added to the corrosive fluid in an amount of 10 to 1000 ppm, preferably 15 to 750 ppm, preferably 20 to 500 ppm, preferably 25 to 400 ppm, preferably 30 to 300 ppm, preferably 35 to 250 ppm, preferably 40 to 200 ppm, preferably 45 to 150 ppm, preferably 50 to 100 ppm, based on a total number of parts of corrosive fluid.

In preferred embodiments, the corrosive fluid comprises carbon dioxide and/or carbonic acid present in an amount of at least 0.5 g carbon dioxide and/or carbonic acid per kg of corrosive fluid, preferably at least 1 g per kg of corrosive fluid, preferably at least 5 g per kg of corrosive fluid, preferably at least 10 g per kg of corrosive fluid, preferably at least 25 g per kg of corrosive fluid, preferably at least 50 g per kg of corrosive fluid, preferably at least 100 g per kg of corrosive fluid, preferably at least 150 g per kg of corrosive fluid, preferably at least 200 g per kg of corrosive fluid. In some embodiments, the corrosive fluid comprises an aqueous solution. Carbon dioxide dissolves in water to create a corrosive solution of dissolved carbon dioxide and carbonic acid. In the oil and gas industry, the mixture of water and carbon dioxide (which may be referred to as "wet carbon dioxide" in situations where the total amount of carbon dioxide exceeds the total amount of water) is frequently encountered during a variety of normal procedures related to oil and gas production. Examples of such procedures include natural gas well drilling, natural gas production, primary oil recovery, secondary oil recovery, tertiary oil recovery, carbon dioxide flooding, and carbon capture and sequestration. In these procedures, carbon dioxide may exist as a gas, liquid, or supercritical fluid. The carbon dioxide may be dissolved into water or some other fluid such as oil. Alternatively, water may dissolve into liquid or supercritical carbon dioxide. In each of these cases, the presence of both carbon dioxide and water will create a corrosive fluid relevant to the corrosion inhibitor of the present disclosure. The amount of carbon dioxide may also be measured based on a partial pressure of carbon dioxide. Typically, corrosion becomes of particular concern for carbon dioxide partial pressures above 1 bar.

In some embodiments, the corrosive fluid comprises an organic solvent. Examples of organic solvents which may be present in the corrosive fluid include, but are not limited to alcohol solvents as described above, ketone solvents such as acetone, methyl ethyl ketone (MEK); amide solvents such as formamide, dimethyl formamide, dimethyl acetamide; halogenated solvents such as carbon tetrachloride, chloroform, bromoform, iodoform, and methylene chloride (also known as dichloromethane); organic acid solvents such as acetic acid, formic acid, and trifluoroacetic acid; aromatic solvents such as benzene, xylenes, toluene, and naptha; ether solvents such as tetrahydrofuran, diethyl ether, and 1,4-dioxane; nitrated solvents such as nitromethane and nitroethane; and ester-containing solvents such as ethyl acetate.

In some embodiments, the corrosive fluid comprises natural or refined petroleum. In some embodiments, the natural or refined petroleum is part of an emulsion. This emulsion may be an oil-in-water emulsion or a water-in-oil emulsion. In some embodiments, the corrosive fluid comprises natural gas. The natural gas may be dissolved in the corrosive fluid or may be a gaseous component of a multiphase mixture which makes up the corrosive fluid, at least one component of which is a liquid. This natural gas may comprise gaseous hydrocarbons, examples of which include alkanes such as methane, ethane, propane, and n-butane, and isobutane; alkenes such as ethane (also known as ethylene) and propene (also known as propylene); and alkynes such as ethyne (also known as acetylene). The natural gas may also comprise carbon monoxide, mercaptans such as methanethiol and ethanethiol, amines such as ammonia and methylamine, and water vapor.

In preferred embodiments, the corrosive fluid is substantially free of hydrogen sulfide. In this context, "substantially free of hydrogen sulfide" may refer to hydrogen sulfide being present in the corrosive fluid in an amount less than 0.5 wt %, preferably less than 0.25 wt %, preferably 0.1 wt %, preferably 0.05 wt %, preferably less than 0.01 wt %, preferably less than 0.005 wt %, preferably less than 0.001 wt %, preferably less than 0.0001 wt %, preferably less than 0.00001 wt %, based on a total weight of corrosive fluid. Alternatively, the amount of hydrogen sulfide may be a relative amount based on an amount of carbon dioxide present in the corrosive fluid. Using such a metric for measuring the amount of hydrogen sulfide, the corrosive fluid preferably has a ratio of the amount of carbon dioxide to the amount of hydrogen sulfide of greater than 30:1, preferably greater than 50:1, preferably greater than 100:1, preferably greater than 150:1, preferably greater than 200:1, preferably greater than 250:1, preferably greater than 300:1, preferably greater than 350:1, preferably greater than 400:1, preferably greater than 450:1, preferably greater than 500:1. In preferred embodiments, the corrosive fluid is devoid of hydrogen sulfide.

The corrosive fluid may optionally further include one or more additives. These additives may be purposefully added to modify the properties or functions of the corrosive fluid, as needed or be inadvertently incorporated into the corrosive fluid through contact between the corrosive fluid or constituents thereof with an additive or additive-containing fluid. Typically, when present, the additive(s) may be incorporated in an amount of less than 10%, preferably less than 8%, preferably less than 6%, preferably less than 4%, preferably less than 2%, preferably less than 1%, preferably less than 0.5%, preferably less than 0.1% by weight per total volume of the corrosive fluid.

Additive(s) suitable for use in oil and gas well operations are known by those of ordinary skill in the art, and may include, but are not limited to:

(i) viscosity modifying agents e.g., bauxite, bentonite, dolomite, limestone, calcite, vaterite, aragonite, magnesite, taconite, gypsum, quartz, marble, hematite, limonite, magnetite, andesite, garnet, basalt, dacite, nesosilicates or orthosilicates, sorosilicates, cyclosilicates, inosilicates, phyllosilicates, tectosilicates, kaolins, montmorillonite, fullers earth, halloysite, polysaccharide gelling agents (e.g., xanthan gum, scleroglucan, and diutan) as well as synthetic polymer gelling agents (e.g., polyacrylamides and co-polymers thereof, see U.S. Pat. No. 7,621,334—incorporated herein by reference in its entirety), psyllium husk powder, hydroxyethyl cellulose, carboxymethylcellulose, and polyanionic cellulose, poly(diallyl amine), diallyl ketone, diallyl amine, styryl sulfonate, vinyl lactam, laponite;

(ii) chelating agents, such as chelating agents useful as sequesteration agents of metal ions, for example iron control agents, such as ethylene diamine tetraacetic acid (EDTA), diethylene triamine pentaacetic acid (DPTA), hydroxyethylene diamine triacetic acid (HEDTA), ethylene diamine di-ortho-hydroxy-phenyl acetic acid (EDDHA), ethylene diamine di-ortho-hydroxy-para-methyl phenyl acetic acid (EDDHMA), ethylene diamine di-ortho-hydroxy-para-carboxy-phenyl acetic acid (EDDCHA);

(iii) stabilizing agents e.g., polypropylene glycol, polyethylene glycol, carboxymethyl cellulose, hydroxyethyl cellulose, polysiloxane polyalkyl polyether copolymers, acrylic copolymers, alkali metal alginates and other water soluble alginates, carboxyvinyl polymers, polyvinylpyrollidones, polyacrylates;

(iv) dispersing agents e.g., polymeric or co-polymeric compounds of polyacrylic acid, polyacrylic acid/maleic acid copolymers, styrene/maleic anhydride copolymers, polymethacrylic acid and polyaspartic acid;

(v) scale inhibitors e.g., sodium hexametaphosphate, sodium tripolyphosphate, hydroxyethylidene diphosphonic acid, aminotris(methylenephosphonic acid (ATMP), vinyl sulfonic acid, allyl sulfonic acid, polycarboxylic acid polymers such as polymers containing 3-allyloxy-2-hydroxypropionic acid monomers, sulfonated polymers such as vinyl monomers having a sulfonic acid group, polyacrylates and copolymers thereof;

(vi) defoaming agents e.g., silicone oils, silicone oil emulsions, organic defoamers, emulsions of organic defoamers, silicone-organic emulsions, silicone-glycol compounds, silicone/silica adducts, emulsions of silicone/silica adducts;

(vii) emulsifiers such as a tallow amine, a ditallow amine, or combinations thereof, for example a 50% concentration of a mixture of tallow alkyl amine acetates, C16-C18 (CAS 61790-60) and ditallow alkyl amine acetates (CAS 71011-03-5) in a suitable solvent such as heavy aromatic naphtha and ethylene glycol; and (viii) surfactants such as non-ionic surfactants as described above, cationic surfactants, anionic surfactants, and amphoteric surfactants.

Cationic surfactants may include, but are not limited to (i) a protonated amine formed from a reaction between a C6-C26 alkyl amine compound and an acid (e.g., acetic acid, formic acid, propionic acid, butyric acid, pentanoic acid, hexanoic acid, oxalic acid, malonic acid, lactic acid, glyceric acid, glycolic acid, malic acid, citric acid, benzoic acid, p-toluenesulfonic acid, trifluoromethanesulfonic acid, hydrochloric acid, nitric acid, phosphoric acid, sulfuric acid, hydrobromic acid, perchloric acid, hydroiodic acid, etc.), such as protonated salts of C6-C26 alkyl monoamines, C6-C26 alkyl (poly)alkylene polyamines, and alkoxylated fatty amines;

(ii) a protonated C6-C26 alkyl amidoamine formed from a reaction between a C6-C26 alkyl amidoamine compound and an acid (for example the acids listed above), such as protonated forms of the amide reaction product between any fatty acid 20 previously listed (or ester derivative thereof) with a polyamine (e.g., putrescine, cadaverine, ethylene diamine, $N^1$,$N^1$-dimethylethane-1,2-diamine, $N^1$,$N^1$-dimethylpropane-1,3-diamine, $N^1$,$N^1$-diethylethane-1,2-diamine, $N^1$,$N^1$-diethylpropane-1,3-diamine, spermidine, 1,1,1-tris(aminomethyl)ethane, tris(2-aminoethyl)amine, spermine, TEPA, DETA, TETA, AEEA, PEHA, HEHA, dipropylene triamine, tripropylene tetramine, tetrapropylene pentamine, pentapropylene hexamine, hexapropylene heptamine, dibutylene triamine, tributylene tetramine, tetrabutylene pentamine, pentabutylene hexamine, hexabutylene heptamine), with specific mention being made to protonated forms of stearamidopropyldimethylamine, stearamidopropyldiethylamine, stearamidoethyldiethylamine, stearamidoethyldimethylamine, palmitamidopropyldimethylamine, palmitamidopropyldiethylamine, palmitamidoethyldiethylamine, palmitamidoethyldimethylamine, behenamidopropyldimethylamine, behenamidopropyldiethylmine, behenamidoethyldiethylamine, behenamidoethyldimethylamine, arachidamidopropyldimethylamine, arachidamidopropyldiethylamine, arachidamidoethyldiethylamine, and arachidamidoethyldimethylamine; and (iii) a quaternary ammonium compound made from alkylation with suitable alkylating agents (e.g., dimethyl sulfate, methyl chloride or bromide, benzyl chloride or bromide, C6-C26 alkyl chloride or bromide, etc.) of a tertiary C6-C26 alkyl amine, an alkoxylated (tertiary) amine, or an aprotic nitrogenous heteroarene (optionally substituted) having at least one aromatic nitrogen atom with a reactive lone pair of electrons, with specific mention being made to a C10-C18 alkyl trimethylammonium chloride or methosulfate, a di-C10-C18 alkyl dimethyl ammonium chloride or methesulfate, a C10-C18 alkyl benzyl dimethyl ammonium chloride, a methyl quaternized C6-C22 alkyl propylene diamine, a methyl quaternized C6-C22 alkyl propylene triamine, a methyl quaternized C6-C22 alkyl propylene tetraamine, a N—C10-C18 alkyl pyridinium or a quinolinium bromide or chloride such as N-octyl pyridinium bromide, N-nonyl pyridinium bromide, N-decyl pyridinium bromide, N-dodecyl pyridinium bromide, N-tetradecyl pyridinium bromide, Ndodecyl pyridinium chloride, N-cyclohexyl pyridinium bromide, naphthyl methylquinolinium chloride, naphthyl methyl pyridinium chloride, and cetylpyridinium chloride.

Anionic surfactants may include, but are not limited to:

(i) sulfates, such as alkyl sulfates, alkyl-ester-sulfates, alkyl ether sulfates, alkylalkoxy-ester-sulfate, sulfated alkanolamides, glyceride sulfates, in particular, sulfates of fatty alcohols or polyoxyalkylene ethers of fatty alcohols such as sodium dodecyl sulfate, sodium laureth sulfate, ammonium lauryl sulfate, potassium lauryl sulfate, sodium myreth sulfate;

(ii) sulfonates such as dodecyl benzene sulfonate, lower alkyl-benzene sulfonates, alpha olefin sulfonates, lignosulfonates, sulfo-carboxylic compounds;

(iii) phosphates of fatty alcohols or polyoxyalkylene ethers of fatty alcohols such as cetyl phosphate salts, dicetyl phosphate salts, ceteth-10-phosphate salts; and (iv) carboxylate salts of fatty acids, acylamino acids, lactylates, and/or fatty alcohols/polyoxyalkylene ethers of fatty alcohols such as sodium stearate, sodium behenoyl lactylate, sodium isostearoyl lactylate, sodium caproyl lactylate, sodium laureth-5 carboxylate, sodium laureth-6 carboxylate, sodium laureth-11 carboxylate.

Amphoteric surfactants may include, but are not limited to:

(i) C6-C22 alkyl dialkyl betaines, such as fatty dimethyl betaines ($R—N(CH_3)_2(^+)—CH_2COO^-$), obtained from a C6-C22 alkyl dimethyl amine which is reacted with a monohaloacetate salt (e.g., sodium monochloroacetate), such as C12-C14 dimethyl betaine (carboxylate methyl C12-C14 alkyl dimethylammonium);

(ii) C6-C22 alkyl amido betaines ($R—CO—NH—CH_2CH_2CH_2—N(CH_3)_2(^+)—CH_2COO^-$ or $R—CO—NH—CH_2CH_2—N(CH_3)_2(^+)—CH_2COO^-$), obtained by the reaction of a monohaloacetate salt (e.g., sodium monochloroacetate) with the reaction product of either dimethyl amino propylamine or dimethyl amino ethylamine with a suitable carboxylic acid or ester derivatives thereof, such as C10-C18 amidopropyl dimethylamino betaine; and (iii) C6-C22 alkyl sultaines or C6-C22 alkyl amido sultaines, which are similar to those C6-C22 alkyl dialkyl betaines or C6-C22 alkyl amido betaines described above except in which the carboxylic group has been substituted by a sulfonic group ($R—N(CH_3)_2(^+)—CH_2CH_2CH_2SO_3^-$ or $R—CO—NH—CH_2CH_2CH_2—N(CH_3)_2(^+)—CH2CH2CH2SO_3^-$ or $R—CO—NH—CH_2CH_2—N(CH_3)_2(^+)—CH_2CH_2CH_2SO_3^-$) or a hydroxysulfonic group ($R—N(CH_3)_2(^+)—CH_2CH(OH)—CH_2SO_3^-$ or $R—CO—NHCH_2CH_2CH_2—N(CH_3)_2(^+)—CH_2CH(OH)—CH_2SO_3^-$ or $R—CO—NH—CH_2CH_2—N(CH_3)_2(^+)—$ $CH_2CH(OH)—CH_2SO_3^-$), such as C10-C18 dimethyl hydroxysultaine and C10-C18 amido propyl dimethylamino hydroxysultaine.

In some embodiments, the corrosive fluid is substantially free of additives (e.g., viscosity modifying agents, chelating agents, stabilizing agents, dispersing agents, scale inhibitors, defoaming agents, and/or surfactants).

In preferred embodiments, the corrosive fluid is an aqueous solution. In preferred embodiments, the corrosive fluid comprises carbon dioxide and/or carbonic acid. In preferred embodiments, the corrosive fluid comprises a dissolved halide salt. In general, the dissolved halide salt may be any suitable halide salt known to one of ordinary skill in the art. Preferably, the halide salt is one which is capable of dissolving in water to an extent so as to create a solution that is at least 0.5 wt % of the dissolved halide salt, based on a total weight of solution. The halide salt may be a fluoride, chloride, bromide, or iodide. In preferred embodiments, the halide salt is a chloride salt. In some embodiments, the halide salt is a metal halide salt. In preferred embodiments, the halide salt is an alkali metal halide salt. Examples of alkali metal halide salts are sodium chloride, potassium chloride, lithium chloride, lithium bromide, sodium bromide, potassium bromide, lithium iodide, sodium iodide, and potassium iodide.

In some embodiments, the dissolved halide salt is present in an amount of 1 to 5 wt %, preferably 1.25 to 4.9 wt %, preferably 1.5 to 4.8 wt %, preferably 1.75 to 4.7 wt %, preferably 1.9 to 4.6 wt %, preferably 2 to 4.5 wt %, preferably 2.1 to 4.4 wt %, preferably 2.2 to 4.3 wt %, preferably 2.3 to 4.2 wt %, preferably 2.4 to 4.1 wt %, preferably 2.5 to 4 wt %, preferably 2.6 to 3.9 wt %, preferably 2.7 to 3.8 wt %, preferably 2.8 to 3.75 wt %, preferably 2.9 to 3.7 wt %, preferably 3 to 3.6 wt %, preferably 3.25 to 3.55 wt %, preferably about 3.5 wt %, based on a total weight of corrosive fluid.

The corrosive fluid may be in contact with many different types of surfaces on tubing and field equipment that are susceptible to corrosion. Illustrative examples of which include, but are not limited to, separation vessels, dehydration units, gas lines, pipelines, cooling water systems, valves, spools, fittings (e.g., such as those that make up the well Christmas tree), treating tanks, storage tanks, coils of heat exchangers, fractionating columns, cracking units, pump parts (e.g., parts of beam pumps), and in particular downhole surfaces that are most likely to come into contact with the corrosive fluid during stimulation operations, matrix acidizing operations, and/or carbon dioxide flooding operations, such as those casings, liners, pipes, bars, pump parts such as sucker rods, electrical submersible pumps, screens, valves, fittings, and the like.

In general, any metal surface that may come into contact with the corrosive fluid may be protected by the corrosion inhibitor or the method of inhibiting corrosion of the present disclosure. Typical metals found in oil and gas field environments that may be protected include carbon steels (e.g., mild steels, high-tensile steels, higher-carbon steels), including American Petroleum Institute (API) carbon steels; high alloy steels including chrome steels, ferritic alloy steels, austenitic stainless steels, precipitation-hardened stainless steels high nickel content steels; galvanized steel, aluminum, aluminum alloys, copper, copper nickel alloys, copper zinc alloys, brass, ferritic alloy steels, and any combination thereof. Specific examples of typical oil field tubular steels include X60, J-55, N-80, L-80, P:105, P110, and high alloy chrome steels such as Cr-9, Cr-13, Cr-2205, Cr-2250, and the like. In preferred embodiments, the methods herein inhibit corrosion of a steel. In preferred embodiments, the metal is a carbon steel, such as AISI 1018 carbon steel or API X-60 carbon steel. The corrosion inhibitor acts to inhibit corrosion in corrosive fluids and at temperatures even up to 100° C., for example at temperatures of 25 to 100° C., preferably 27.5 to 90° C., preferably 30 to 80° C., preferably 35 to 75° C., preferably 40 to 70° C., preferably 45 to 65° C., preferably 50 to 60° C. In preferred embodiments, the oil and gas well is treated with the corrosive fluid at a temperature of 40 to 75° C., preferably 45 to 65° C., preferably 50 to 60° C., preferably 55° C.

Corrosion rate is the speed at which metals undergo deterioration within a particular environment. The rate may depend on environmental conditions and the condition or type of metal. Factors often used to calculate or determine corrosion rate include, but are not limited to, weight loss (reduction in weight of the metal during reference time), area (initial surface area of the metal), time (length of exposure time) and density of the metal. Corrosion rate may be measured according to the American Society for Testing and Materials (ASTM) standard weight loss (immersion) test (e.g., according to ASTM G3 and G59 and described in the Examples), and may be computed using mils penetration per year (mpy). In some embodiments, the method provides a corrosion rate of 1 to 25 mpy, preferably 2.5 to 15 mpy, preferably 3 to 10 mpy, preferably 5 to 9.5 mpy, preferably 5.5 to 9 mpy, preferably 5.75 to 8.50 mpy, when the metal is treated with the corrosive fluid containing 3.5 wt. % NaCl, saturated carbon dioxide, and 50 to 100 ppm of the corrosion inhibitor at 55° C.

Corrosion inhibition efficiencies (IE %) may be measured by comparing the corrosion rates obtained from corrosive fluids with and without corrosion inhibitors using weight loss (immersion) studies, electrochemical impedance spectroscopy (EIS), potentiodynamic polarization (PDP), Linear polarization resistance (LPR) or other similar methods. In some embodiments, the method described herein achieves a corrosion inhibition efficiency of greater than 90%, preferably greater than 90.25%, preferably greater than 90.5%, preferably greater than 90.75%, preferably greater than 91%, preferably greater than 91.25%, preferably greater than 91.5%, preferably greater than 91.75%, preferably greater than 92%, preferably greater than 92.25%, preferably greater than 92.5%, preferably greater than 92.75%, preferably greater than 93%, preferably greater than 93.25%, preferably greater than 93.5%, preferably greater than 93.75%, preferably greater than 94%, preferably greater than 94.25%, preferably greater than 94.5%, preferably greater than 94.75%, preferably greater than 95%, greater than 95.2% when the metal is treated with the corrosive fluid containing 3.5 wt. % NaCl, saturated carbon dioxide, and 50 to 100 ppm of the corrosion inhibitor at 55° C.

The examples below are intended to further illustrate protocols for and are not intended to limit the scope of the claims.

Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

Examples

TABLE 1

Composition of Corrosion Inhibitor (CoRE-C-1)

| Composition | Weight % |
|---|---|
| Ethanolamine | 26.6% |
| Hexamethylenetetramine | 20.0% |
| 2-mercaptoethanol | 26.6% |
| Linear alkyl alcohol ethoxylate-7 | 6.6% |
| Methanol | 20.0% |

Corrosion Evaluation Tests

The performance of the corrosion inhibitor formulation was conducted according to the G3 and G59 ASTM standard methods [ASTM G3, Practice and Conventions Applicable to Electrochemical Measurements in Corrosion Testings, West Conshohocken, Pa.: ASTM Reapproved 2014; and ASTM G59, Test Method for conducting Potentiodynamic Polarization Resistance Measurements, West Conshohocken, Pa.: ASTM Reapproved 2014]. Cylindrical carbon steel (C-1018) coupon with exposed surface area of 5.23 $cm^2$ was used for corrosion testing. Two concentrations of 50 and 100 ppm were used to evaluate the performance of the corrosion inhibitor formulation. The test was carried out at a temperature of 55° C. in a 3.5% NaCl solution (blank). $CO_2$ gas was bubbled through the blank solution for the first two hours to de-aerate and was continuously bubbled throughout the experiment to simulate sweet corrosive condition. Furthermore, the solution was continuously stirred at a flow speed of 500 rpm throughout the test. After 2 hours of purging the corrosive fluid with $CO_2$ and the test temperature set at 55° C., the test coupon was immersed into the corrosion cell and open circuit potential (OCP) was measured for 1 h to ensure the stability of the potential with time. Finally, the corrosion measurements using linear polarization resistance (LPR), electrochemical impedance spectroscopy (EIS) and potentiodynamic polarization measurements (PDP) were performed after another 2 h after OCP measurements. The EIS measurements was carried out with frequency range from 100 kHz to 0.1 Hz with an AC amplitude of 10 mV. LPR was performed within ±20 mV/$E_{corr}$ using 0.167 mV/s as the scan rate. Finally, the PDP curves were measured with potentials from −250 to +250 mV vs. SCE using a 0.5 mV/s scan rate.

Inhibition efficiency (IE %) values were calculated from the electrochemical measurements using equations 6 and 7.

$$IE_{EIS/LPR} = 1 - \frac{R_{p(blank)}}{R_{p(inh)}} \times 100\% \quad (6)$$

where $R_{p(blank)}$ and $R_{p(inh)}$ are, respectively, the polarization resistance recorded in the absence and presence of corrosion inhibitor formulation.

$$IE_{PDP} = 1 - \frac{i_{corr(inh)}}{i_{corr(blank)}} \times 100\% \quad (7)$$

where $i_{corr\ (blank)}$ and $i_{corr\ (inh)}$ are, respectively, the corrosion current density recorded in the absence and presence of corrosion inhibitor formulation.

OCP Vs Time Results

Figure 2:
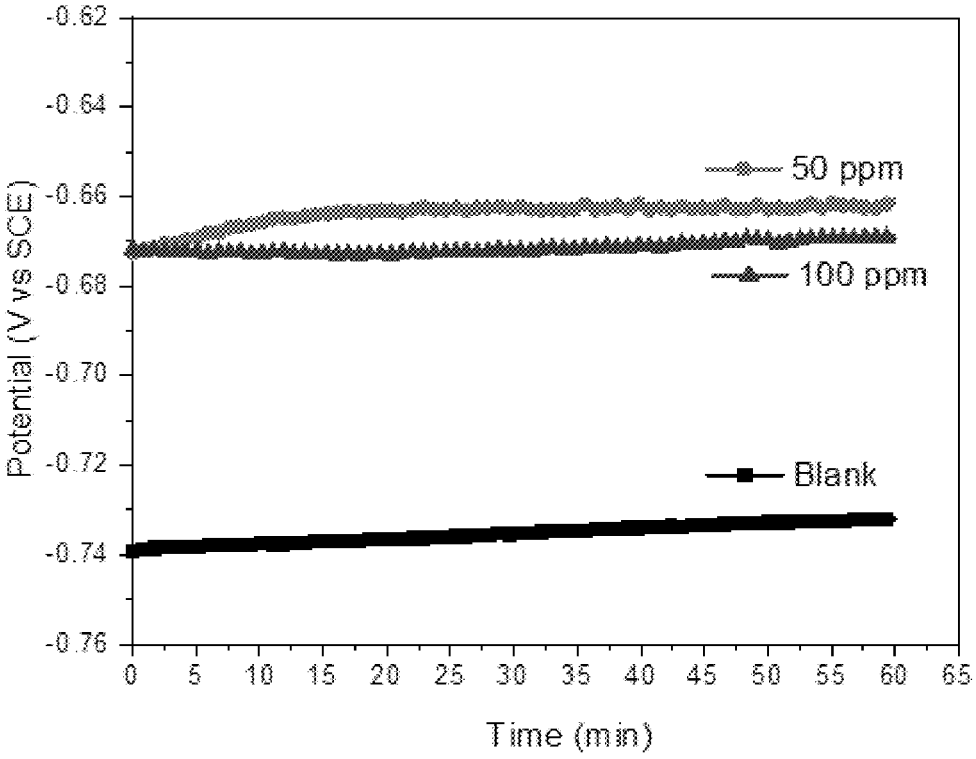
FIG. 2 is a plot of the open circuit potential vs time for C1018 carbon steel coupon in 3.5% NaCl in saturated $CO_2$ at 55° C. without and after the addition of 50 and 100 ppm of the corrosion inhibitor formulation CoRE-C-1 after 1 h immersion.

The variation of OCP with time for C1018 carbon steel coupon in 3.5% NaCl in saturated $CO_2$ at 55° C. without and after the addition of 50 and 100 ppm of CoRE-C-1 after 1 h immersion is presented in FIG. 2. The results from FIG. 2 indicate that the carbon steel reached a stable OCP without CoRE-C-1 (blank) and with different concentrations of CoRE-C-1 after 1 h immersion. Overall, the final OCP for the blank solution was more negative but became positive with the addition of 50 and 100 ppm of CoRE-C-1. This clearly shows that the corrosion inhibitor formulation can protect the carbon steel from corrosion.

LPR Results

Linear polarization measurements were conducted to collect data of the corrosion rates and inhibition efficiency of the C1018 carbon steel coupon in the absence and presence of 50 and 100 ppm of CoRE-C-1. The results are presented in Table 2. Results obtained in Table 2 show that the addition of different concentrations of the inhibitor reduces the corrosion rate from 169.10 mpy without the inhibitor (blank) to 8.35 mpy in the presence of 50 ppm of CoRE-C-1. This was further decreased to 5.77 mpy with 100 ppm of the inhibitor. Similarly, the inhibition efficiency of 96.6% was obtained at 100 ppm compared to 95.0% at 50 ppm. The LPR result shows the high efficacy of the corrosion inhibitor formulation even at a reduced concentration of 50 ppm.

TABLE 2

Linear polarization data obtained for C1018 carbon steel coupon in 3.5% NaCl in saturated $CO_2$ at 55° C. without and after the addition of 50 and 100 ppm of CoRE-C-1.

| CoRE-C-1 | $E_{corr}$ (mV) | $i_{corr}$ ($\mu Acm^{-2}$) | Rp (ohms) | C.R. (mpy) | IE (%) |
|---|---|---|---|---|---|
| Blank | −731.2 | 1935.0 | 13.5 | 169.10 | |
| 50 ppm | −653.7 | 95.6 | 272.6 | 8.35 | 95.0 |
| 100 ppm | −656.5 | 66.1 | 394.4 | 5.77 | 96.6 |

Electrochemical Impedance Spectroscopy Results

Figure 3A:
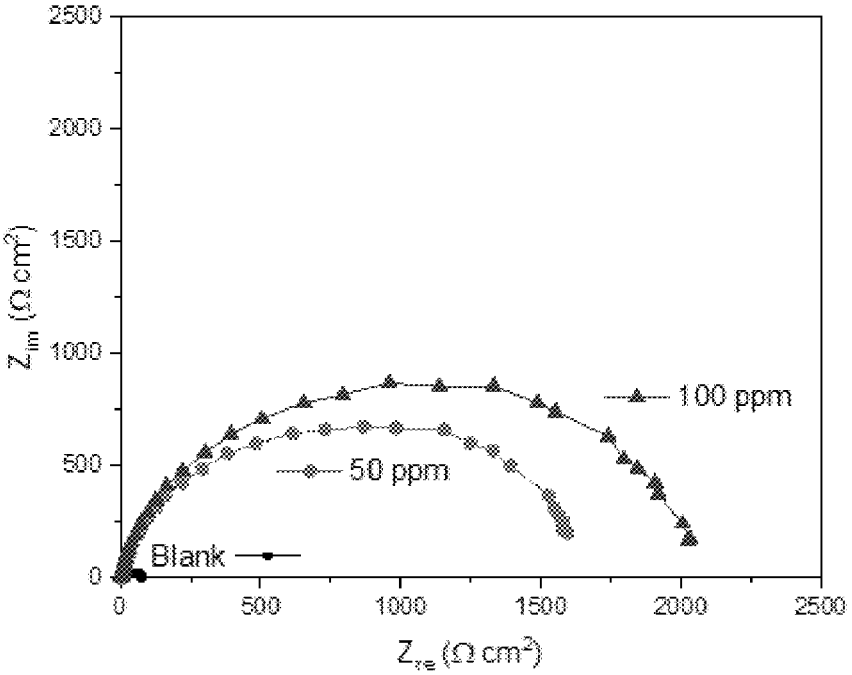
FIGS. 3A and 3B show electrochemical impedance spectroscopy results where
Figure 3B:
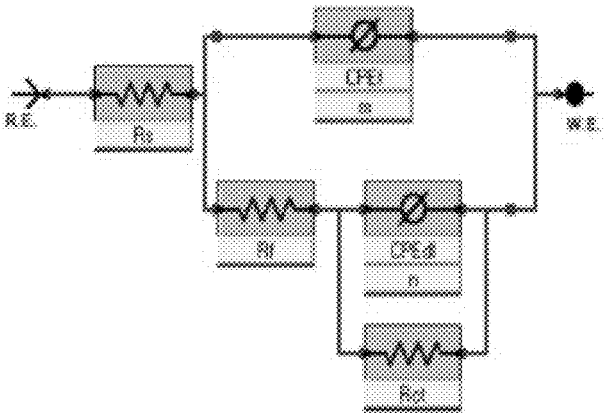
Figure 4:
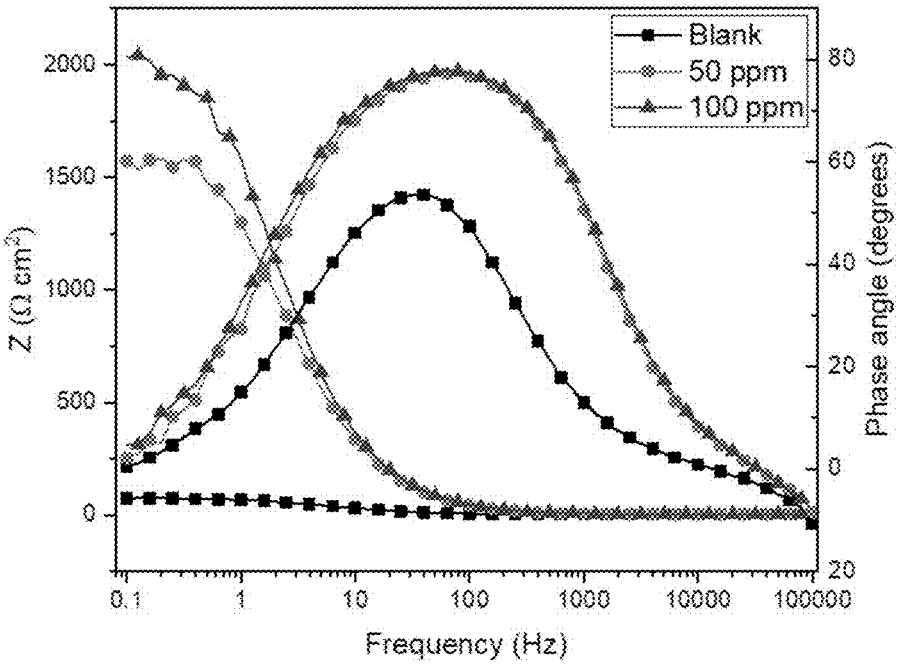
FIG. 4 shows Bode plots for the electrochemical impedance spectroscopy for C1018 carbon steel coupon in 3.5% NaCl in saturated $CO_2$ at 55° C. without and after the addition of 50 and 100 ppm of the corrosion inhibitor formulation CoRE-C-1.

Electrochemical impedance measurements were also conducted to obtain more information on the kinetics and mechanism of CoRE-C-1 to protect steel in the simulated sweet oilfield condition. FIG. 3A shows Nyquist plots and FIG. 4 shows Bode plots for C1018 carbon steel coupon in 3.5% NaCl in saturated $CO_2$ at 55° C. without and after the addition of 50 and 100 ppm of CoRE-C-1. Also, electrochemical kinetic parameters obtained from EIS data are presented in Table 3. As shown in the Nyquist curves (FIG. 3A), the addition of different concentrations of CoRE-C-1 to the 3.5% NaCl saturated $CO_2$ solution (blank) significantly increased the diameters of the Nyquist spectra. This shows that the addition of the inhibitor into the corrosive medium reduces drastically the corrosion rate of C1018 carbon steel and protects it against corrosion. In the similar manner, the Bode plots presented in FIG. 4 show a sharp increase in the impedance values with addition of 50 and 100 ppm of CoRE-C-1 compared with the blank indicating better protection of C1018 carbon steel in the presence of the inhibitor.

TABLE 3

Electrochemical kinetic parameters obtained from EIS data for C1018 carbon steel coupon in 3.5% NaCl in saturated CO2 at 55° C. without and after the addition of 50 and 100 ppm of CoRE-C-1.

| | | $CPE_f$ | | | $CPE_{dl}$ | | | | | |
|---|---|---|---|---|---|---|---|---|---|---|
| CoRE-C-1 | $R_s$ ($\Omega$ $cm^2$) | $Y_0$ ($\mu\Omega^{-1}$ $s^n$ $cm^{-2}$) | m | $R_f$ ($\Omega$ $cm^2$) | $Y_0$ ($\mu\Omega^{-1}$ $s^n$ $cm^{-2}$) | n | $R_{ct}$ ($\Omega$ $cm^2$) | $C_{dl}$ ($\mu$F $cm^{-2}$) | Rp ($\Omega$ $cm^2$) | IE (%) |
| Blank | 3.03 | | | | 901.9 | 0.83 | 72.8 | 4521 | 75.8 | |
| 50 ppm | 3.67 | 29.1 | 1.00 | 22.3 | 56.6 | 0.73 | 1653 | 407 | 1656 | 95.4 |
| 100 ppm | 3.67 | 46.7 | 0.95 | 410.2 | 48.0 | 0.62 | 1711 | 1141 | 1714 | 95.6 |

Results presented in Table 3 indicate that the Rp values in the blank was 75 ($\Omega$ $cm^2$). This value jump significantly to 1656 ($\Omega$ $cm^2$) with 50 ppm of CoRE-C-1 and even to a much higher value of 1714 ($\Omega$ $cm^2$) at 100 ppm of the inhibitor. The results from EIS shows that inhibition efficiency of up to 95.6% was obtained at 100 ppm. The results from EIS is corroborates the LPR results.

Potentiodynamic Polarization Results

Figure 5:
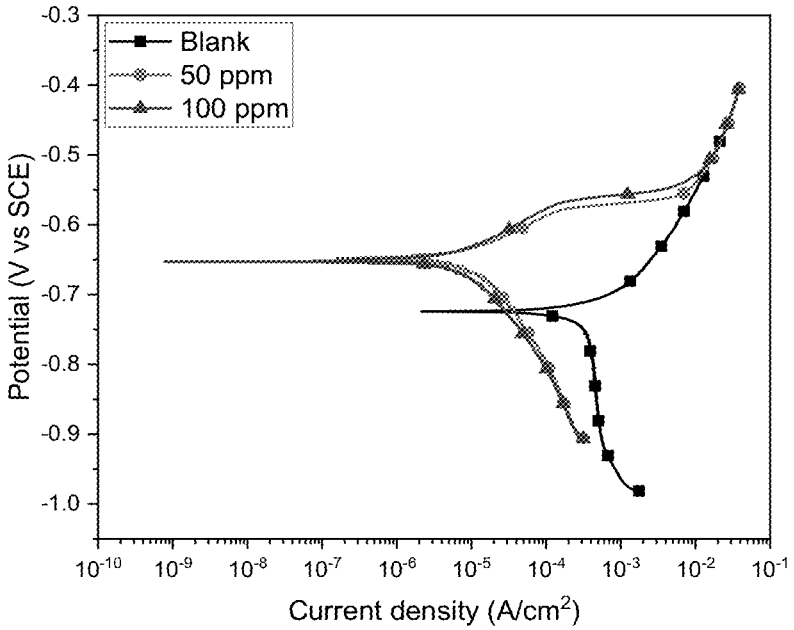
FIG. 5 shows Tafel plots of the potentiodynamic polarization experiments for C1018 carbon steel coupon in 3.5% NaCl in saturated $CO_2$ at 55° C. without and after the addition of 50 and 100 ppm of the corrosion inhibitor formulation CoRE-C-1.

Potentiodynamic polarization (Tafel) plots were obtained to investigate further the anodic and cathodic electrochemical processes that occur on the C1018 carbon steel surface during the corrosion and the corrosion inhibition processes. FIG. 5 shows the potentiodynamic polarization (Tafel) curves for C1018 carbon steel in 3.5% NaCl in saturated $CO_2$ at 55° C. without and after the addition of 50 and 100 ppm of CoRE-C-1. Also, Table 4 presents the various kinetic electrochemical corrosion parameters, such as the corrosion current density ($i_{corr}$), corrosion potential ($E_{corr}$), corrosion rates (mpy) and anodic and cathodic Tafel slopes ($\beta_a$, $\beta_c$) obtained from the extrapolation of the anodic and cathodic Tafel lines. It is evident from FIG. 5, that the addition of different concentrations of CoRE-C-1 shifted the potential to anodic side when compared with the blank. This clearly shows that the inhibitor is anodic in nature. The $E_{corr}$ was shifted from −724 mV to −653 mV with the addition of 100 ppm of the corrosion inhibitor. The corrosion current density also decreases from 388 ($\mu$A/$cm^2$) to 12.5 ($\mu$A/$cm^2$) showing a 31-fold decreased. This reduces the corrosion rate of the C1018 carbon steel from 177.4 mpy (blank) to 5.7 mpy with the addition of 100 ppm of CoRE-C-1. This leads to inhibition efficiency of 96.8%. All the electrochemical results (LPR, EIS and PDP) are in excellent agreement with each other.

TABLE 4

PDP data for C1018 carbon steel coupon in 3.5% NaCl in saturated $CO_2$ at 55° C. without and after the addition of 50 and 100 ppm of CoRE-C-1.

| | | | PDP results | | | |
|---|---|---|---|---|---|---|
| CoRE-C-1 | βa (mV/decade) | βc (mV/decade) | $E_{coor}$ (mV) | $I_{corr}$ ($\mu$A/$cm^2$) | CR (mpy) | IE (%) |
| Blank | 45.5 | 135.8 | −724.0 | 388.0 | 177.4 | |
| 50 ppm | 124.9 | 209.8 | −648.0 | 18.4 | 8.385 | 95.2 |
| 100 ppm | 220.3 | 174.6 | −653.0 | 12.5 | 5.708 | 96.8 |

The invention claimed is:

1. A corrosion inhibitor, comprising:

15 to 30 wt % of an alkanolamine having 2 to 8 carbon atoms;

10.5 to 30 wt % of a polyamine having 2 to 12 carbon atoms;

15 to 30 wt % of a thioglycol having 2 to 8 carbon atoms;

1 to 9 wt % of a non-ionic surfactant; and 1 to 58.5 wt % of an alcohol solvent, each based on a total weight of corrosion inhibitor, wherein the corrosion inhibitor is substantially free of sulfonic acids.

2. The corrosion inhibitor of claim 1, wherein the alkanolamine is ethanolamine.

3. The corrosion inhibitor of claim 1, wherein the polyamine is hexamethylenetetramine.

4. The corrosion inhibitor of claim 1, wherein the thioglycol is 2-mercaptoethanol.

5. The corrosion inhibitor of claim 1, wherein the non-ionic surfactant is an alcohol ethoxylate of formula (1)

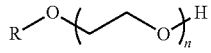

(1)

wherein R is a linear hydrocarbon chain having 8 to 22 carbon atoms and n is an integer 2 to 12.

6. The corrosion inhibitor of claim 5, wherein n=7.

7. The corrosion inhibitor of claim 5, wherein R is a saturated linear hydrocarbon chain having 8 to 22 carbon atoms.

8. The corrosion inhibitor of claim 5, wherein R is a linear hydrocarbon chain having 14 to 20 carbon atoms.

9. The corrosion inhibitor of claim 1, wherein the alcohol solvent is methanol.

10. A method of inhibiting corrosion of a metal in contact with a corrosive fluid, the method comprising adding to the corrosive fluid the corrosion inhibitor of claim 1 in an amount of 10 to 1000 ppm based on a total number of parts of the corrosive fluid.

11. The method of claim 10, wherein the corrosive fluid is an aqueous solution.

12. The method of claim 10, wherein the corrosive fluid comprises carbon dioxide and/or carbonic acid in an amount of at least 0.5 g carbon dioxide and/or carbonic acid per kg of corrosive fluid.

13. The method of claim 12, wherein the corrosive fluid further comprises a dissolved halide salt.

14. The method of claim 13, wherein the dissolved halide salt is present in an amount of 1 to 5 wt % based on a total weight of corrosive fluid.

15. The method of claim 12, wherein the corrosive fluid is substantially free of hydrogen sulfide.

16. The method of claim 10, wherein the metal is a steel.

17. The method of claim 16, wherein the steel is a carbon steel.

18. The method of claim 10, wherein the metal is in contact with the corrosive fluid at 25 to 100° C.

19. The method of claim 10, wherein the metal is part of a casing, a pipe, a pump, a screen, a valve, or a fitting of an oil or gas well.

20. The method of claim 10, wherein the method has an inhibition efficiency of greater than 90% when the metal is in contact with the solution at 30 to 70° C. for 30 to 90 minutes.

* * * * *